United States Patent [19]

Berg et al.

[11] 3,985,670

[45] Oct. 12, 1976

[54] LIQUID REGULATED-FOAM DETERGENT COMPOSITIONS

[75] Inventors: Markus Berg, Dusseldorf-Holthausen; Jürgen Hoffmeister, Dusseldorf-Benrath; Günter Jakobi, Hilden Rhineland; Peter Krings, Krefeld, all of Germany

[73] Assignee: Henkel & Cie G.m.b.H., Dusseldorf-Holthausen, Germany

[22] Filed: May 21, 1974

[21] Appl. No.: 471,860

[30] Foreign Application Priority Data

June 1, 1973 Germany ..... 2327857

[52] U.S. Cl. ..... 252/117; 252/110; 252/122; 252/132; 252/545; 252/546; 252/DIG. 1; 252/DIG. 11; 252/DIG. 14

[51] Int. Cl.[2] ..... C11D 9/30; C11D 15/04

[58] Field of Search ..... 252/117, DIG. 1, DIG. 11, 252/132, 545, 546, 110, DIG. 14, 122

[56] References Cited

UNITED STATES PATENTS

| | | | |
|---|---|---|---|
| 3,619,119 | 11/1971 | Felletschin et al. | 252/138 LN |
| 3,812,041 | 5/1974 | Inamorato | 252/89 |

*Primary Examiner*—Mayer Weinblatt
*Attorney, Agent, or Firm*—Hammond & Littell

[57] ABSTRACT

Liquid phosphate-free, regulated-foam washing agent compositions comprising:

a. from 15% to 60% by weight of a mixture of ethylene oxide adducts to aliphatic organic compounds having from 12 to 30 carbon atoms and a replaceable hydrogen atom with degrees of ethoxylation of 2 to 6 and 8 to 20 where the ratio of the 2 to 6 ethoxylated compound to the 8 to 20 ethoxylated compound in the mixture is from 1:5 to 2:1, b. from 0.2% to 8% by weight of foam inhibitors selected from the group consisting of non-surface-active foam inhibitors, soap and mixtures thereof in a weight ratio of non-surface-active foam inhibitors to soap of from 1:2 to 1:4, c. from 0.3% to 15% by weight of at least one water-soluble salt of an organic compound capable of sequestering calcium, said organic compound being selected from the group consisting of aminoalkane polycarboxylic acids, carboxymethyl derivatives having at least 2 carboxyl groups, polymeric carboxylic acid compounds with a molecular weight of over 350 and at least one carboxyl group per each molecular weight unit of 175, phosphonoalkane polycarboxylic acids, aminoalkanepolyphosphonic acids and hydroxyalkanepolyphosphonic acids, d. from 10% to 40% by weight of water-soluble or water-emulsifiable aliphatic organic solvents having no more than 7 carbon atoms and at least one hydrophilic group, e. the remainder up to 100% by weight of water and, optionally, optical brighteners, soil suspension agents, wash alkalis, antimicrobial substances, hydrotropic compounds, dyes and perfumes.

2 Claims, No Drawings

LIQUID REGULATED-FOAM DETERGENT COMPOSITIONS

THE PRIOR ART

It is known that detergents with strong foaming power, as they are used in hand washing and for tub washing machines, cannot be used in the drum type washing machines without great foaming over the wash liquor, particularly in the boiling temperature range. Regulated-foam washing agent compositions have therefore been put on the market which show a sufficiently strong foaming power in the temperature range of 20° to 50° C so that they are also suitable for manual washing and for tub washing machines. With further increasing temperatures, particularly above 80° C, these washing agent compositions form only a small amount of foam so that they can also be used in drum-type washing machines under boiling temperature washing conditions. These detergents generally contain, as a wash-active component, a synthetic anionic surface-active compound from the group of the sulfonate and sulfate surface-active compounds together with foam-inhibiting compounds, for which soaps and/or non-ionic surface-active compounds, are generally used. The use of non-surface-active foam inhibitors, such as alkyl melamines, silicone oils, fatty ketones, paraffins, etc. is also known.

Though these known detergents have satisfactory foaming properties, the washing and cleaning power of these washing agent compositions left much to be desired.

Another disadvantage of these known detergents is their high content of condensed phosphates, which is udesirable because the same is believed to lead to eutrophication of lakes and rivers.

The problem was therefore to develop a liquid regulated foam washing agent composition of improved washing power, particularly with regard to hydrophobic soil, and to forego the use of condensed phosphates altogether in order to contribute this way to the desired reduction of the phosphate concentration in the sewage.

OBJECTS OF THE INVENTION

An object of the present invention is the development of a liquid phosphate-free, regulated foam washing agent composition comprising:

a. from 15% to 60% by weight of a mixture of low and high ethoxylated ethylene oxide adducts to aliphatic organic compounds having from 12 to 20 carbon atoms and a replaceable hydrogen atom selected from the group consisting of alkanols, alkenols, alkanediols, alkylamines, alkenylamines, alkanoic acids, alkenoic acids, alkylamides, alkenylamides, alkylsulfonamide and alkenylsulfonamide, with degrees of ethoxylation of 2 to 6 and 8 to 20 where the ratio of the 2 to 6 ethoxylated compound to the 8 to 20 ethoxylated compound in the mixture is from 1:5 to 2:1, b. from 0.2% to 8.0% by weight of foam inhibitors selected from the group consisting of non-surface-active foam inhibitors in an amount of from 0.2% to 0.8% by weight, soaps in an amount of from 1.5% to 8.0% by weight and mixtures of non-surface-active foam inhibitors and soaps in the aforesaid amounts, c. from 0.3% to 15% by weight of at least one water-soluble salt of an organic compound capable of sequestering calcium, said organic compound being selected from the group consisting of aminoalkane polycarboxylic acids, alkane polyphosphonic acids, carboxymethyl derivatives of alkanepolyols having 2 to 6 carbon atoms and hydroxyalkane-carboxylic acids having 3 to 6 carbon atoms, said carboxymethyl derivatives having at least 2 carboxyl groups, polymeric carboxylic acid compounds with a molecular weight of over 350 and at least one carboxyl group per each molecular weight unit of 175, phosphonoalkane polycarboxylic acids, aminoalkanepolyphosphonic acids and hydroxyalkanepolyphosphonic acids, d. from 10% to 40% by weight of a water-soluble or water-emulsifiable aliphatic organic solvent having no more than 7 carbon atoms selected from the group consisting of alkanols and alkanediols having from 1 to 5 carbon atoms, esters thereof with alkanoic acids having no more than 4 carbon atoms and ethers thereof with hydroxyalkanols having no more than 4 carbon atoms, e. from 0 to 10% by weight of conventional liquid washing agent composition ingredients selected from the group consisting of optical brighteners, soil suspension agents, wash alkalis, antimicrobial compounds, hydrotropic compounds, dyes and perfumes, and f. the balance, up to 100% by weight, of water, with the proviso that a 1% aqueous solution of the said liquid washing agent composition has a pH of 8.5 to 10.

These and other objects of the present invention will become more apparent as the description thereof proceeds.

DESCRIPTION OF THE INVENTION

The above objects have been achieved and the drawbacks of the prior art have been overcome by the present invention, which is a liquid, phosphate-free, regulated foam washing agent composition comprising:

a. from 15% to 60& of a mixture of aliphatic polyoxyethylene glycol derivatives from the group of ethoxylated compounds having 12 to 20 carbon atoms such as alcohols, alkanediols, alkylamines, alkanecarboxylic acids, alkane carbonamides or alkane sulfonamides with degrees of ethoxylation of 2 to 6 and 8 to 20, where the mixing ratio of the lower ethoxylated compound to the higher ethoxylated compound is from 1:5 to 2:1, b. from 0.2% to 8.0% by weight of a foam inhibitor component, composed of 0.2% to 0.8% by weight of a non-surface-active foam inhibitor and/or 1.5% to 8.0% by weight of a soap, c. from 0.3% to 15% by weight of organic salts capable of sequestering calcium ions from the group of water-soluble salts of polycarboxylic acids with, optionally, hydroxyl and ether functions, aminopolycarboxylic acids, alkanepolyphosphonic acids, phosphonoalkane polycarboxylic acids, amino-substituted alkanepolyphosphonic acids and hydroxyl-substituted alkanepolyphosphonic acids, d. from 10% to 40% by weight of alcohols, ether alcohols or esters with not more than 4 carbon atoms in the acid radical and in the possibly ether bound alcohol residues, e. the balance up to 100% by weight of water and, optionally, optical brighteners, soil suspension agents, wash alkalis, antimicrobial compounds, hydrotropic compounds, dyes and perfumes.

The individual components of the washing agent compositions according to the invention, particularly the salt components, are so selected that the preparations have a pH of between 8.5 and 10 in a 1% aqueous solution.

More particularly, therefore, the present invention involves a liquid phosphate-free, regulated foam washing agent composition comprising:

a. from 15% to 60% by weight of a mixture of low and high ethoxylated ethylene oxide adducts to aliphatic organic compounds having from 12 to 20 carbon atoms and a replaceable hydrogen atom selected from the group consisting of alkanols, alkenols, alkanediols, alkylamines, alkenylamines, alkanoic acids, alkenoic acids, alkylamides, alkenylamindes, alkylsulfonamide and alkenylsulfonamide, with degrees of ethyoxylation of 2 to 6 and 8 to 20 where the ratio of the 2 to 6 ethoxylated compound to the 8 to 20 ethoxylated compound in the mixture is from 1:5 to 2:1, b. from 0.2% to 8.0% by weight of foam inhibitors selected from the group consisting of non-surface-active foam inhibitors in an amount of from 0.2% to 0.8% by weight, soaps in an amount of from 1.5% to 8.0% by weight and mixtures of non-surface-active foam inhibitors and soaps in the aforesaid amounts, c. from 0.3% to 15% by weight of at least one water-soluble salt of an organic compound capable of sequestering calcium, said organic compound being selected from the group consisting of aminoalkane polycarboxylic acids, alkane polyphosphonic acids, carboxymethyl derivatives of alkanepolyols having 2 to 6 carbon atoms and hydroxyalkane-carboxylic acids having 3 to 6 carbon atoms, said carboxymethyl derivatives having at least 2 carboxyl groups, polymeric carboxylic acid compounds with a molecular weight of over 350 and at least one carboxyl group per each molecular weight unit of 175, phosphonoalkane polycarboxylic acids, aminoalkanepolyphosphonic acids and hydroxyalkanepolyphosphonic acids.

d. from 10% to 40% by weight of a water-soluble or water-emulsifiable aliphatic organic solvent having no more than 7 carbon atoms selected from the group consisting of alkanols and alkanediols having from 1 to 5 carbon atoms, esters thereof with alkanoic acids having no more than 4 carbon atoms and ethers thereof with hydroxyalkanols having no more than 4 carbon atoms, e. from 0 to 10% by weight of conventional liquid washing agent composition ingredients selected from the group consisting of optical brighteners, soil suspension agents, wash alkalis, antimicrobial compounds, hydrotropic compounds, dyes and perfumes, and f. the balance, up to 100% by weight, of water, with the proviso that a 1% aqueous solution of the said liquid washing agent composition has a pH of 8.5 to 10.

In order to adjust the liquid preparations of the invention to the desired pH of between 8.5 and 10 in a 1% aqueous solution, the organic sequestering agents of component (c) are employed in the form of a water-soluble salt which gives a pH of about 10 in a 1% aqueous solution. If necessary, the desired pH of 8.5 to 10 is obtained by the addition of wash alkalis. The salt components of the liquid preparations according to the invention are preferably used as potassium salts. The wash alkalis, when employed, are therefore preferably utilized as the potassium salt, although other alkali metal salts may be employed. These are therefore potassium carbonate, potassium bicarbonate, potassium borate and the potassium silicates with a $K_2O:SiO_2$ ratio of 1:1 to 1:3.5.

The washing agent compositions according to the invention have an excellent washing power, recognizable by the maintenance of a good brightness, particularly with regard to hydrophobic dirt on textiles of synthetic fibers. In the washing of textile of the various fibers of synthetic or natural origin, the washing agent compositions of the invention are characterized by their insensitivity to hard water and, because of their foaming stability over the entire washing temperature range, they are particularly suitable for use in drum-type washing machines. The preparations according to the invention contain the wash-active substances in high concentration. Due to the absence of condensed phosphates which are normally found in detergents, the phosphate concentration in the sewage can be considerably reduced by the use of these preparations.

The polyoxyethylene glycol derivatives of the aliphatic compounds having from 12 to 20 carbon atoms and a replaceable hydrogen atom that can be used according to the invention are particularly the addition products of 2 to 6 mols of ethylene oxide and those of 8 to 20 mols of ethylene oxide adducted to 1 mol of fatty alcohol, fatty acid, fatty amine, fatty acid amide or alkane sulfonamide of the indicated chain length. Particularly preferred are the addition products of 2 to 6 mols of ethylene oxide and those of 8 to 20 mols of ethylene oxide adducted to 1 mol of an alcohol having 12 to 20 carbon atoms of the type of alkanols or alkenols or alkanediols. Especially preferred are ethoxylation products of fatty alcohols having from 12 to 20 carbon atoms. These are produced in known manner from the corresponding alkanols and alkenols. These alcohols can be both of synthetic and of natural origin. The mixture of the ethoxylation products according to the invention with different degrees of ethoxylation is obtained, for example, by mixing the separately produced ethoxylation products.

According to the invention, the following reaction products can be utilized. These are the adduct of:

1 mol of tallow fatty alcohol and 14 mols of ethylene oxide 1 mol of tallow fatty alcohol and 5 mols of ethylene oxide 1 mol of coconut fatty alcohol and 12 mols of ethylene oxide 1 mol of coconut fatty alcohol and 3 mols of ethylene oxide 1 mol of a mixed oleyl/cetyl alcohol, iodine number 30 to 50, and 10 mols of ethylene oxide 1 mol of a mixed oleyl/cetyl alcohol, iodine number 30 to 50, and 5 mols of ethylene oxide 1 mol of a $C_{11}$ to $C_{15}$ Oxo-alcohol (about 10% to 30% of $\alpha$-methyl branching) and 3 mols of ethylene oxide, 1 mol of a $C_{11}$ to $C_{15}$ Oxo-alcohol (about 10% to 30% of $\alpha$-methyl branching) and 13 mols of ethylene oxide, 1 mol of a secondary $C_{11}$ to $C_{15}$ alcohol mixture (produced by paraffin oxidation) and 3 mols of ethylene oxide, 1 mol of a secondary $C_{11}$ to $C_{15}$ alcohol mixture (produced by paraffin oxidation) and 9 mols of ethylene oxide, 1 mol of a secondary $C_{15}$ to $C_{17}$ alkanediol (non-terminal hydroxyls) and 5 mols of ethylene oxide, 1 mol of a secondary $C_{15}$ to $C_{17}$ alkanediol (non-terminal hydroxyls) and 9 mols of ethylene oxide.

The washing agent compositions according to the invention contain a foam inhibitor for the regulation of the foam in an amount of from 0.2% to 8.0% by weight.

This foam inhibitor is composed of either 0.2% to 0.8% by weight of a non-surface-active foam inhibitor or of 1.5% to 8.0% by weight of a foam inhibiting soap or both. The foam inhibiting soaps according to the invention are the alkali metal salts of saturated fatty acids whose chain length distribution is in the range of $C_{12}$ to $C_{22}$.

In a preliminary wash step or in the washing of fine textiles (fine washing) or in the rinsing of washed laundry, particularly in washing machines, that is, at liquor temperatures of 20° C to 60° C, a satisfactory regulation of the foam is already achieved with soaps which have a chain length distribution of $C_{12}$ to $C_{18}$. The chain length distribution of the soap used as a foam inhibitor is therefore selected with advantage to correspond to the range of application of the washing agent composition according to the invention. Preparations which are suitable both for fine washing and for high temperature washing, particularly in drum washing machines, can also contain mixtures of soaps of various origins, so that they have a balanced chain length distribution of substantially $C_{12}$ to $C_{22}$. With particular advantage the foam-inhibiting soaps in the preparations according to the invention are used together with a non-surface-active foam inhibitors, where the quantitative ratio between the soap and the non-surface-active foam inhibitor can vary within the indicated quantitative range of between 20:1 and 3:1. In this way a supplementation of the action of both foam inhibitors is obtained, since the foam inhibition action of the soap in the prewashing or heating phase and during the rinsing cycles is advantageously supplemented by non-surface-active foam inhibitors, particularly in the high temperature range so that an excellent foam regulation can be achieved in all common machine washing methods.

The non-surface-active foam inhibitors that can be used according to the invention are generally water-insoluble, mostly aliphatic compounds containing from 8 to 22 carbon atoms. Preferred non-surface-active foam inhibitors of the preparations according to the invention are the N-alkylaminotriazines, that is, reaction products of 1 mol of cyanuric chloride with 2 to 3 mols of a mono- or dialkylamine with preferably 8 to 18 carbon atoms in the alkyls. Also suitable are propoxylated and/or butoxylated aminotriazines, e.g., the reaction products of 1 mol of melamine with 5 to 10 mols of propylene oxide and additionally 10 to 50 mols of butylene oxide, as well as the aliphatic alkanones having 18 to 40 carbon atoms, ketones, like stearone, the fatty acid ketones from hardened train fatty acid or tallow fatty acid, etc. Suitable are also the paraffins and haloparaffins with melting points below 100° C, as well as polymeric siliconorganic compounds of the type of the silicone oils.

The production of the liquid preparations according to the invention is generally effected by mixing the components. The salt components are preferably dissolved in water, using, with advantage, demineralized water. The components which dissolve difficulty in pure water, such as the optical brighteners without water-solubilizing groups, or perfumes, are incorporated, preferably by dissolving them first in a suitable organic solvent according to the invention.

The organic solvents utilized in the liquid washing agent compositions of the invention as liquid carriers are water-soluble or emulsifiable with water, aliphatic organic solvents having no more than 7 carbon atoms, particularly alkanols and alkanediols having from 1 to 5 carbon atoms, esters thereof with alkanoic acids having no more than 4 carbon atoms and ethers thereof with hydroxyalcohols having no more than 4 carbon atoms, for example, ethanol, isopropanol, butanol, amyl alcohol, ethylene glycol, diethylene glycol, triethylene glycol, ethyl acetate, etc. The water-soluble solvents are preferred.

The salts of organic compounds capable of sequestering calcium ions of the above definition, suitable for use in the compositions of the invention, are preferably the water-soluble salts, particularly the alkali metal salts, such as the potassium salts, of the following classes of compounds:

1. The aminopolycarboxylic acids, such as amino-lower-alkanoic acids and polyamino-lower-alkanepoly-lower-alkanoic acids, for example, nitriloacetic acid, ethylenediaminetetraacetic acid, diethylenetriaminepentaacetic acid, as well as higher homologs.

2. The lower alkane polyphosphonic acids, such as methane diphosphonic acid.

3. The amino- and hydroxy-substituted alkane polyphosphonic acids, having 1 to 9 carbon atoms, such as 1-aminoethane-1,1-diphosphonic acid, amino-trimethylene-phosphonic acid, methylamino- or ethylamino-di-methylene-phosphonic acid, ethylene diaminetetra-methylenephosphonic acid, dimethylaminomethane-diphosphonic acid, 1-hydroxyethane-1,1-diphosphonic acid, etc.

4. The phosphonoalkane polycarboxylic acids with 1 and 2 phosphono and 2 and 3 carboxyl groups and 4 to 9 carbon atoms, such as 1-phosphonoethane-1,2-dicarboxylic acid, 2-phosphonopropane-2,3-dicarboxylic acid, 1,1-diphosphonopropane-2,3-dicarboxylic acid, 2-phosphonobutane-1,2,4-tricarboxylic acid, 2-phosphonobutane-2,3,4-tricarboxylic acid, etc.;

5. Suitable as nitrogen-free and phosphorus-free carboxylic acids, which form complex salts with calcium ions, are, for example, the alkali metal salts, preferably the potassium salt of citric acid, tartaric acid, benzene hexacarboxylic acid.

6. The polymeric carboxylic acids with molecular weights over 350, and at least one carboxyl group per each molecular weight unit of 175, such as polyacrylic acid, poly-$\alpha$-hydroxyacrylic acid, the polycarboxylic acids obtained from mixed polymerization of maleic acid anhydride with ethylene or propylene, isobutylene or styrene, or with vinyl methyl ether or furan, or with acrylic acid, as well as the polyhydroxy-carboxylic acids obtained from acrolein and acrylic acid with $H_2O_2$ and the Cannizzaro reaction, etc.; 7. The carboxymethylated, polyhydric $C_2$ to $C_6$ alcohols and $C_3$ to $C_6$ hydroxycarboxylic acids, containing at least two carboxyl groups in the molecule, preferably the carboxymethyl derivatives of alkanepolyols having 2 to 6 carbon atoms and hydroxyalkane-carboxylic acids having 3 to 6 carbon atoms, such as the compounds: dicarboxymethyl-ethylene glycol and dicarboxymethyl-diethylene glycol, tricarboxylmethyl-glycerine, mono- and di-carboxymethyl-glyceric acid, carboxymethyl-tartronic acid, carboxymethyl-methyl-tartronic acid, carboxymethyl-maleic acid, mono- and di-carboxymethyl-tartaric acid, also the carboxymethylated derivatives of glutaric acid, saccharic acid, mucic acid, gluconic acid, the erythritols, pentaerythritol, 2,2-dihydroxymethyl-propanol, sorbitol, mannitol, xylitol, etc.;

Other salt components, which are suitable because of their hydrotropic action, are the salts of the non-surface-active sulfonic acids, carboxylic acids and sulfocarboxylic acids containing 2 to 9 carbon atoms, for example, the alkali metal salts of the benzenesulfonic acid, toluenesulfonic acid or xylenesulfonic acids, of sulfoacetic acids, and sulfosuccinic acid, as well as the salts of acetic acid and lactic acid. Short-chained aminoalkanols, such as mono- or di- and triethanolamine are also suitable as hydrotropic substances. Opacifiers, for example, ethylene glycol distearate or polystyrene, can also be added to the liquid preparations.

As soil suspension agents or greying-inhibitors the preparation according to the invention can contain carboxymethyl celluloses or other cellulose-ether carboxylic acids or cellulose ether sulfonic acids in order to improve the soil suspension capacity of the wash liquor, particularly with regard to cotton textiles. Other suitable greying-inhibitors are polyanionic polymers, such as polyesters or polyamides, which can be obtained from tri- or tetracarboxylic acids and diols, diamines or N-alkyl-dialkanolamines, and still containing free carboxyl groups capable of forming salts, or the alkali metal salts of polymeric sulfonic acids, for example, of polyvinyl sulfonic acids, polyesters and polyamides of sulfosuccinic acid, sulfonated phenol-formaldehyde condensates or the reaction products obtained from polyesters of dicarboxylic acids and N-alkyldialkanolamines by reaction with sultones or halogenalkanesulfonic acids.

Also suitable as soil suspension agents are non-ionic water-soluble or water-dispersible polymers, such as methyl-cellulose, hydroxyethyl-cellulose, ethoxylated starch, polyvinyl alcohol, partly saponified polyvinyl acetate, polyvinyl pyrrolidone, polyoxyethylene glycols, polyacrylic acid amide, and polyethylene-imine, as well as partly alkylated polyethylene-imines or polyethylene-imines reacted with substoichiometric amounts of dicarboxylic acids.

The washing agents can contain optical brighteners such as those for cotton, particularly derivatives of diaminostilbenedisulfonic acid or its alkali metal salts. Suitable are, for example, salts of 4,4'-bis-(2-anilino-4-morpholino-1, 3,5-triazin-6-yl-amino)-stilbene-2,2'-disulfonic acid or similarly compounds which have instead of the morpholino group, a diethanolamino group, a methylamino group or a 2-methoxyethylamino group. Brighteners for polyamide fibers which can be used are those of the type of the 1,3-diaryl-2-pyrazolines, for example, the compound 1-(p-sulfamoylphenyl)-3-(p-clorophenyl)-2-pyrazoline, as well as compounds of similar composition which have instead of the sulfamoyl group, for example, the methoxycarbonyl group, the 2-methoxyethoxycarbonyl group, the acetylamino group or the vinylsulfonyl group. Suitable polyamide brighteners are also the substituted aminocumarins, for example, 4-methyl-7-dimethylamino-cumarin or 4-methyl-7-diethylamino-cumarin. Furthermore, the compounds 1-(2-benzimidazolyl)-2-(1-hydroxyethyl-2-benzimidazolyl)-ethylene and 1-ethyl-3-phenyl-7-diethylamino-carbostyril can also be used as polyamide brighteners. Brighteners for polyester and polyamide fibers which can be used are the compounds 2,5-di-(2-benzoxazolyl) thiophene, 2-(2-benzoxazolyl)-naphtho-[2,3-b]-thiophene and 1,2-di-(5-methyl-2-benzoxazolyl)-ethylene. Furthermore, brighteners of the type of the substituted 4,4'-distyryl-diphenyls can be utilized, for example, the compound 4,4'-bis-(4-chloro-3-sulfostyryl)-diphenyl. Mixtures of the above-mentioned brighteners can likewise be used.

Suitable antimicrobial substances with a bactericidal, bacteriostatic or fungicidal or fungistatic action and which are water-soluble as such or in the form of their salts can be employed in the powdery compositions of the invention. Among these are the quaternary ammonium compounds which contain in the molecule one long-chained aliphatic and two short-chained aliphatic hydrocarbon radicals, and an aromatic organic radical linked over an aliphatic carbon atom with the nitrogen atoms, or an aliphatic radical with double bonds, such as dimethyl-benzyldodecyl ammonium chloride or dibutyl-allyl-dodecyl ammonium chloride. Suitable active substances are also the bromo and nitro substituted alkanols and alkanediols having 3 to 5 carbon atoms, for example, 2-bromo-2-nitropropane-1,3-diol, 1-bromo-1-nitro-3,3,3-trichloro-2-propanol, 2-bromo-2-nitro-butanol, as well as phenolic compounds of the type of the halogenated phenols, the halogenated alkylphenols, halogenated cycloalkylphenols, halogenated aralkylphenols, and halogenated phenylphenols, the halogenated alkylene bisphenols, the halogenated hydroxybenzoic acid derivatives, and the preferably halogen-substituted phenoxyphenols, such as 2-hydroxy-2',4,4'-trichloridiphenyl ether. Suitable for preservation of the liquid preparations as antimicrobial substances are also, for example, formaldehydes as an aqueous solution, benzoic acid, salicylic acid and sorbic acid.

The following examples are illustrative of the practice of the invention without being limitative in any respect.

EXAMPLES the examples describe compositions of some liquid preparations according to the invention. The various compounds capable of forming salts are employed in the form of the potassium salt unless otherwise noted. The following designations and abbreviations are used:

"KA + 3 EO", "KA + 10 EO", "TA + 5EO", "TA + 14 EO", "OCA + 5 EO", "OCA + 10 EO" represent the addition products of 3, 5, 10 and 14 mols of ethylene oxide (EO) adducted to 1 mol of technical coconut fatty alcohol (KA), or tallow fatty alcohol (TA), or mixed oleyl/cetyl alcohol (OCA), having an iodine number of 30 to 50.

"Soap A" is a soap made of a fatty acid mixture of 21% by weight $C_{12}$, 8% by weight $C_{14}$, 4% by weight $C_{16}$, 22% by weight $C_{18}$, 8% by weight $C_{20}$ and 37% by weight $C_{22}$ (iodine number 4).

"Soap B" is a soap made of a fatty acid mixture with 20% by weight $C_{12}$, 12% by weight $C_{14}$, 25% by weight $C_{16}$, 43% by weight $C_{18}$ (iodine number 3).

"Soap C" is a soap made of the hardened $C_{12}$ to $C_{18}$ fatty acids of coconut oil (iodine number 2).

"Foam inhibitor I" is a mixture of about 45% of a N,N'-di-(alkylamino)-chlorotriazine and about 55% of a N,N',N''-tri(alkylamino)-triazine, where the alkyl radicals are present in these triazine derivatives as a mixture of homologs with 8 to 18 carbon atoms.

"Foam inhibitor II" is a commercial silicone oil "SAG 100" R.

"EDTA" and "ATTP" = the salts of ethylenediaminetetraacetic acid and aminotri-methylenephosphonic acid.

"CMC" = the salt of carboxymethyl cellulose, of substitution degree: 0.7 to 0.8.

"Cotton brightener" = a compound of the formula 4,4'-bis-(2-anilino-4-morpholino-1,3,5-triazin-6-yl-amino)-stilbene-2,2'-disulfonic acid-sodium salt.

"Polyamide brightener" = a compound of the formula 1-(p-sulfoamoylphenyl)-3-(p-chlorophenyl)-2-pyrazoline.

All percents are percent by weight.

TABLE I

| Component of Preparation | % By Weight According to Example 1 | 2 | 3 | 4 | 5 | 6 | 7 |
|---|---|---|---|---|---|---|---|
| KA + 3 EO | — | — | 7.5 | — | — | — | — |
| KA + 10 EO | — | — | 10 | — | — | — | — |
| TA + 5 EO | — | — | — | 5 | — | — | 10 |
| TA + 14 EO | — | 10 | — | 10 | — | — | 20 |
| OCA + 5 EO | 10 | 5 | — | — | 25 | — | — |
| OCA + 10 EO | 20 | — | — | — | 25 | — | — |
| Soap A | 5 | — | — | 4.5 | 6 | — | 2.5 |
| Soap B | — | 4 | 3 | — | — | — | — |
| Soap C | — | — | — | — | — | — | 3.5 |
| Foam inhibitor I | — | 0.2 | — | — | — | — | — |
| Foam inhibitor II | — | — | 0.2 | — | — | — | — |
| Xylenesulfonate | — | 2 | 3 | 2 | — | — | — |
| $K_2CO_3$ | — | — | — | 4.5 | — | — | — |
| $K_2O \cdot 2.4\ SiO_2$ | 3.5 | — | — | — | — | — | 3.5 |
| EDTA | 5 | — | — | 0.3 | 0.3 | — | — |
| ATTP | — | 0.3 | — | — | — | — | 0.4 |
| 1-Hydroxyethane-1,1-diphosphonate | — | — | 4.5 | — | — | — | — |
| Carboxymethyl tartronate | — | — | — | 6 | — | — | — |
| Potassium salt of polyvinyl ether/maleic acid anhydride copolymer ("GANTREZ AN 139") | — | 8 | — | — | — | — | — |
| CMC | — | 0.5 | 0.2 | 0.5 | — | — | 0.6 |
| Cotton brightener | — | 0.2 | 0.2 | 0.15 | — | — | 0.2 |
| Polyamide brightener | — | 0.02 | — | 0.02 | — | — | 0.02 |
| Ethanol | 25 | — | 10 | — | 25 | — | — |
| Isopropyl alcohol | — | 18 | 15 | 25 | — | — | 25 |

Balance: Water, dyes, perfumes and preservatives.

If the lower and higher ethoxylated alcohols used in the examples were replaced by the corresponding ethoxylated secondary alcohols, oxo-alcohols or alkanediols, comparable results were obtained with these preparations. Even when washing in hard water, a good brightness is achieved with the liquid, phosphate-free preparations according to the invention, compared to the known preparations with a high tripolyphosphate content, and no additional formation of incrustations on the laundry or deposits on machine parts is observed. The preparations according to the invention have an excellent fat removal capacity. This can be seen, for example, on collars and cuffs of men's shirts, particularly those of wash-and-wear cotton or cotton-polyester blends, and on fat-stained uniforms, as they are used by kitchen personnel, butchers, gas station operators, garage mechanics, etc.

The preceding specific embodiments are illustrative of the practice of the invention. It is to be understood, however, that other expedients known to those skilled in the art or disclosed herein may be employed without departing from the spirit of the invention or the scope of the appended claims.

We claim:

1. A liquid phosphate-free, regulated foam washing agent composition consisting essentially of:

a. from 15% to 60% by weight of a mixture of low and high ethoxylated ethylene oxide adducts to fatty alcohols having from 12 to 20 carbon atoms, with degrees of ethoxylation of 2 to 6 and 8 to 20 where the ratio of the 2 to 6 ethoxylated compound to the 8 to 20 ethoxylated compound in the mixture is from 1:5 to 2:1, b. from 0.2% to 8.0% by weight of foam inhibitors selected from the group consisting of non-surface-active foam inhibitors in an amount of from 0.2% to 0.8% by weight, alkali metal salts of saturated fatty acids having a chain length distribution in the range of 12 to 22 carbon atoms in an amount of from 1.5% to 8.0% by weight and mixtures of non-surface-active foam inhibitors and soaps in the aforesaid amounts, c. from 0.3% to 15% by weight of at least one water-soluble salt of an organic compound capable of sequestering calcium, said organic compound being selected from the group consisting of aminoalkane polycarboxylic acids, alkane polyphosphonic acids, carboxymethyl derivatives of alkanepolyols having 2 to 6 carbon atoms and hydroxy-alkane-carboxylic acids having 3 to 6 carbon atoms, said carboxymethyl derivatives having at least 2 carboxyl groups, polymeric carboxylic acid compounds with a molecular weight of over 350 and at least one carboxyl group per each molecular weight unit of 175, phosphonoalkane polycarboxylic acids, aminoalkanepolyphosphonic acids and hydroxyalkanepolyphosphonic acids, d. from 10% to 40% by weight of a water-soluble or water-emulsifiable organic solvent having no more than 7 carbon atoms selected from the group consisting of alkanols and alkanediols having from 1 to 5 carbon atoms, esters thereof with alkanoic acids having no more than 4 carbon atoms and ethers thereof with hydroxyalkanols having no more than 4 carbon atoms, e. from 0 to 10% by weight of at least one of the following: optical brighteners, soil suspension agents, wash alkalis, antimicrobial compounds, hydrotropic compounds and opacifiers, and f. the balance, up to 100% by weight, of water, with the proviso that a 1% aqueous solution of the said liquid washing agent composition has a pH of 8.5 to 10.

2. The liquid washing agent composition of claim 1 wherein, in components (a), the ratio of the 2 to 6 ethoxylated compound to the 8 to 20 ethoxylated compound in the mixture is from 1:3 to 1:1.

* * * * *